United States Patent [19]

Mooneyhan

[11] Patent Number: 4,905,988

[45] Date of Patent: Mar. 6, 1990

[54] COMBINATION DUMBELL, HAND-GRIP EXERCISER AND HANDGOAL DEVICE

[76] Inventor: Betty F. Mooneyhan, 13 Third St., Clarksdale, Miss. 38614

[21] Appl. No.: 263,283

[22] Filed: Oct. 27, 1988

Related U.S. Application Data

[63] Continuation-in-part of Ser. No. 214,004, Jun. 30, 1988, abandoned, which is a continuation-in-part of Ser. No. 83,031, Aug. 7, 1987, abandoned, which is a continuation-in-part of Ser. No. 17,924, Feb. 24, 1987, abandoned, and a continuation of Ser. No. 1,963, Jan. 9, 1987, abandoned.

[51] Int. Cl.[4] ..... A63B 11/08

[52] U.S. Cl. ..... 272/68; 272/122; 272/135; 273/129 R; 273/129 K; 273/318; 273/412

[58] Field of Search ..... 272/67, 68, 119, 122, 272/123, 132, 135, 140, 143, DIG. 4, 106–108; 273/129 R, 129 K, 129 W, 318, 323–326, 412; 425/276

[56] References Cited

U.S. PATENT DOCUMENTS

| | | | |
|---|---|---|---|
| 1,026,215 | 5/1912 | Korth | 272/122 X |
| 3,075,769 | 1/1963 | Cunningham | 273/318 |
| 3,349,621 | 10/1967 | Mullen | 272/68 X |
| 3,406,968 | 10/1968 | Mason | 272/119 |
| 4,093,211 | 6/1978 | Hughes et al. | 272/68 |
| 4,218,057 | 8/1980 | Wilson | 272/119 X |
| 4,756,522 | 7/1988 | Sandoval | 272/68 |

FOREIGN PATENT DOCUMENTS

| | | | |
|---|---|---|---|
| 29241 | 12/1912 | United Kingdom | 273/412 |

*Primary Examiner*—Richard J. Apley
*Assistant Examiner*—David J. Bender

[57] ABSTRACT

A combination dumbell, hand-grip exerciser and handgoal device having two open cavity chambers each having a rim, and two projecting guidelanes inside each chamber, for directing a ball; and two cover lids to seal contents put within the chambers for weighting the device. The device includes actuators consisting of two arms, hinge structures, a removeable pivot rod and a plurality of single-loop coil springs, placeable into the inner arm's spring slots, for grip pressure of the device. All are secured together with a wing nut fixed to the extending end of the pivot rod. The device includes a ball, safety strap and rubber strap.

4 Claims, 5 Drawing Sheets

COMBINATION DUMBELL, HAND-GRIP EXERCISER AND HANDGOAL DEVICE

This application is a continuation in part serial number 07/214,004 filed 6/30/88 which is now abandoned; which is a continuation in part serial number 07/083,031 filed 8/7/87 which is now abandoned, which is a continuation in part serial numbers 07/017,924 and 07/001,963 also abandoned, filed 2/24/87 and 1/9/87, respectively.

BACKGROUND OF THE INVENTION

1. Field of the Invention

The present invention relates to a dumbell and hand-grip exerciser in conjunction with a ball throwing and catching handgoal device.

2. Description of Prior Art

Heretofore, various exercise and ball game catching devices, and the like, have been developed. None of these, however, has the features of the present invention. Example;

| | | | |
|---|---|---|---|
| | UNITED STATES PATENTS | | |
| 4,629,186 | 12/1986 | ALDRIDGE | |
| 194,294 | 12/1962 | GREIF (design) | |
| 749,147 | 1/1904 | AYELOTT | |
| 208,787 | 10/1967 | PRESSCOTT (design) | |
| 4,632,384 | 12/1986 | BRIGHT | |
| 1,026,515 | 5/1912 | KORTH | |
| 4,756,522 | 7/1988 | SANDOVAL | |
| 4,155,552 | 5/1979 | JACOBO et al | |
| 1,175,035 | 3/1916 | WOOSTER | |
| 3,711,096 | 1/1973 | CRAMP et al | |
| 3,061,311 | 10/1962 | VON ARHHERN | |
| 3,289,246 | 12/1966 | DEYE | |
| 1,562,432 | 11/1925 | BERSCH | |
| | FOREIGN PATENTS | | |
| 2,523,339 | 3/1967 | DENKO | FRANCE |
| 1,023,996 | 2/1958 | BUCHHOLZ | GERMANY |
| 29,241 | 9/1913 | GODSON | BRITAIN |

SUMMARY

It is an object of the present invention to provide an exerciser—dumbell/hand-grip, excerciser-type device that can also be applied as a ball throwing and catching handgoal device.

It is also an object of this invention to provide a hand-grip exerciser that can be loaded with one to five individual tension springs allowing different grip pressures to be obtained by the device, offering a way for the device to be used by children, teens, or adults, male and female.

Still, another object is to provide a ball-game catching and throwing device that can be adjusted in grip pressure by way of selectively placing one, two, three, four or five pressure springs into said device for increased or decreased grip pressure.

DESCRIPTION OF THE PREFERRED EMBODIMENT(S)

Figure 1:
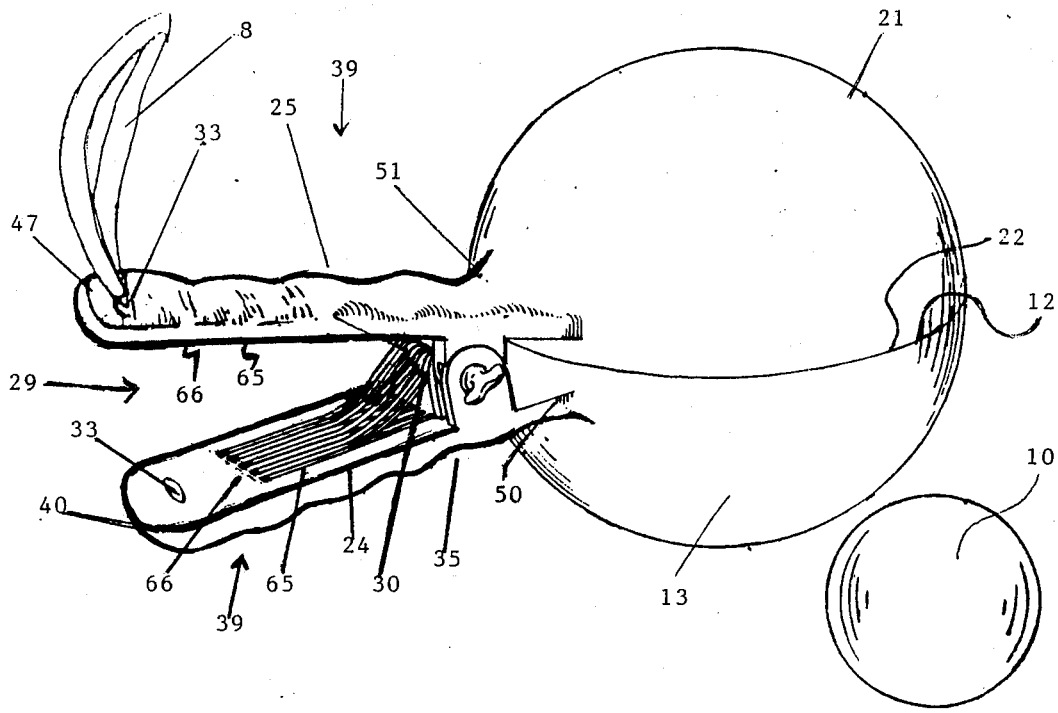
FIG. 1 is a prespective view of the present invention having a safety strap and showing a ball.

The device of the present invention described herein is used as a hand-held, hand-grip exciser with adjustable tension. The present device can also be used as a dumbell. The present device can be used as a ball catcher and thrower. Each use can be used independently or in combination.

Let it be known that the primary use of the present invention is the use of the handgoal for ball play.

Prior art shows Bersch, Deye, and Godson (Britain) show bowl members which may catch a ball. Von Arhhern, Buchholz (Germany), Cramp et al., and Wooster all show spring biased ball catchers. Sandoval shows spring arrangements and slots. Denko (France) discloses in FIG. 1 a clamp (solid), a pivotal attachment of the end pieces, spring means, flat clamping surfaces, hinge means, and actuator means. However, none of these show means for advancing tension, compression of dividing weight, or guidelanes for directing a ball when thrown therefrom, or other uses independent of one another.

The pivotal hand-grip exciser, dumbell, and advancing grip hand-held, catcher/thrower handgoal device of the present invention consists of two halves that mirror image one another, and join together to form a unit. The device has attachable, but releaseable components that expand the scope and spirit of the device.

Preferrably, the two halves of the device are injection-molded of durable, light-weight plastic and/or plastic compounds, or the like, that will withstand breakage from the weight of the chambers, rapid movement, and the fast impact of an incoming ball.

The specific construction of the first and second chambers may vary, although the present invention shows the chambers in ball-shape form; a square, triangle, oval, or any shape may be used.

Referring initially to FIGS. 1,3,6 and 8 of the present invention: the device includes a first chamber 13 having an open cavity defining an interior surface having two projected guidelanes 41,42 integral of said chamber's inner surface, the first chamber 13 also having a rim 12. The device includes a second chamber 21 having an open cavity defining an interior surface having two projected guidelanes 43,44 integral of said chamber's inner surface. The second 21 chamber also has a rim 22. The said guidelanes are spaced apart from one another in a parallel, horizonal (from arms), cresent-like manner, aligned 41 with 43, and 42 with 44** inside the separate chambers. The space between the guidelanes should be spaced so that a ball, or the like, may fall therein, and follow outwardly to a directed designation of play, thus maintaining precision when thrown from the chambers. Note: The guidelanes may be of any shape.

Now to use the handgoal as a dumbell, two cover lids 53,59 are offered. The first cover lid 53 fits over the open (filled) mouthway of the first chamber 13. The second cover lid 59 fits over the open (filled) mouthway of the second chamber 21. Simply fill each open cavity of each chamber with water, sand, or any suitable substance, for weighting the device. Screw-on, or snap-on, the cover lids to the chambers to seal the contents within. Now the device may be used as a dumbell, that pivots (divides apart). For the pivotal effects of the first and second chambers 13,21 and the joining of the unit, the device has hinge means 29. When the hinge means 29 are joined the rims 12,22 of the first and second chambers touch one another. One half of the hinge means 29 is an integral part (lower) of the first arm member 24, and the second half of the hinge means 29 is an integral part (lower) of the second arm member 25. The said hinge means are on the inner surfaces of the arms, and joined together to form a complete hinge. The first arm 24 has a first end 50 integral with the first chamber 13, and the second arm 24 has a first end 51 integral with the second chamber 21.

The first longitudinal arm 24 (Fig.2), having a plurality of spring slots 66 and half the hinge means 29 integrally thereof, is integral on the exterior of the first chamber 13. The second longitudinal arm 25 (FIG. 2), having a plurality of spring slots 66 and half the hinge 29 means integrally thereof, is integral on the exterior of the second chamber 21. The longitudinal spring slots 66 may be injection molded into the inner arm surfaces and aligned so as to match in each arm. Each spring slot 66 is to have (above) a designed marking in like manner. A one arm, and A the second arm, and so on. Example; A,B,C,D,E (65, represent all spring slots, both arms, 24,25). NOTE: The arms, hinge means, and spring slots, may vary in shape, to those skilled in the arts.

Figure 5:
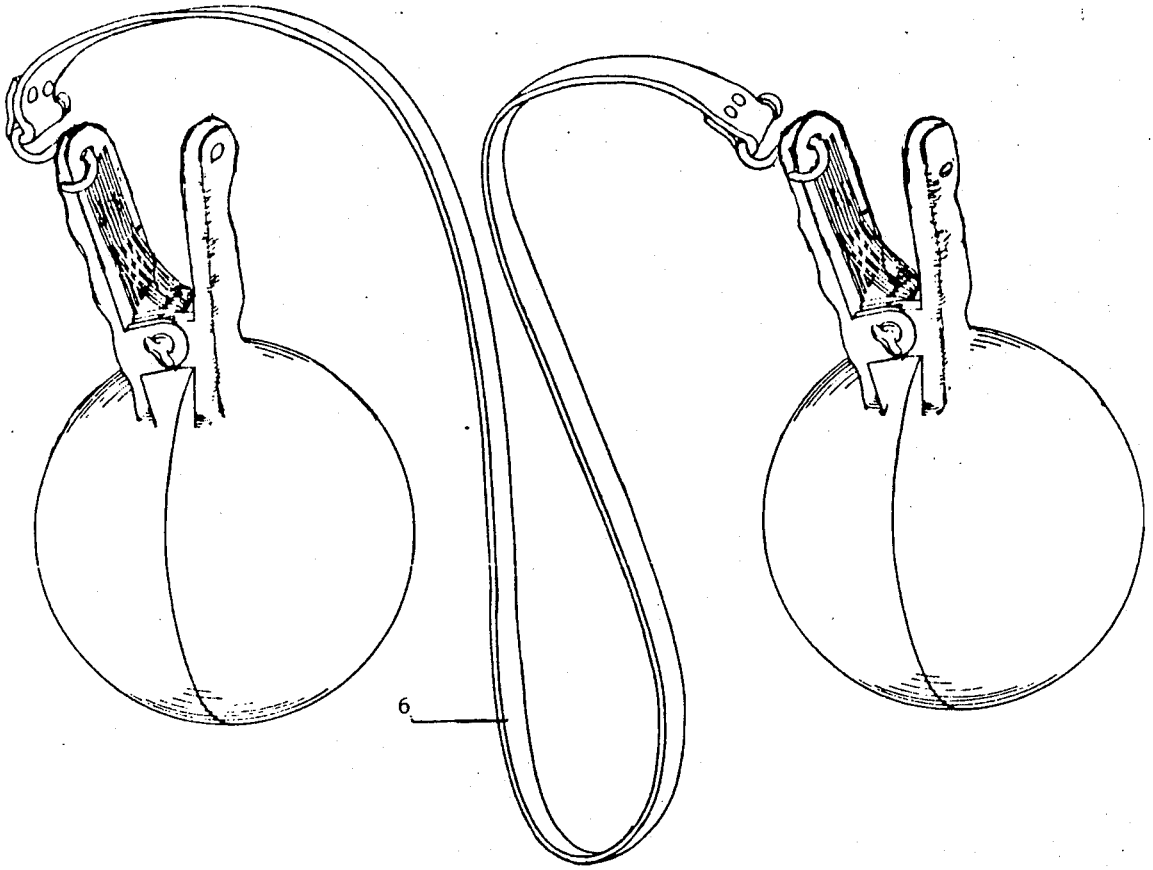
FIG. 5 is a prespective view of two units connected to a rubber strap.
Figure 6:
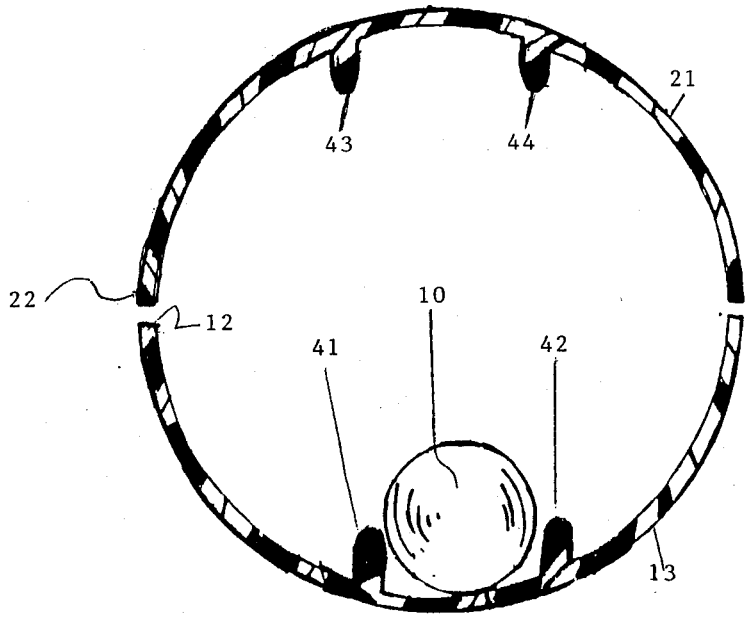
FIG. 6 is a transverse sectional view of the chambers showing guidelanes.

The second ends 40,47 (Fig.1) of the first 24 and second arm 25 may have an aperture 33 (33 represents both apertures) in each arm's second end 40,47. The apertures 33 are to serve as a point of connection for a nylon, or the like, safety strap 8 (Fig.1). The safety strap 8 is for safety of the user when the device is used for weight lifting and fast ball play, as explained later. The apertures 33 also serve as a connection point of a rubber, or the like, resilient strap 6 (Fig. 5). The resilient strap 6 connects to one unit, in an aperture of either arm, and the second end connects to a second unit, in an aperture of either arm. The user then pulls the two units apart (weighted or unweighted) against the resilience of the rubber strap while simultaneously and repetitiously, lifting, pressing, pulling and swinging weight. Said straps 6 or 8 may connect in any manner to unit(s).

Figure 2:
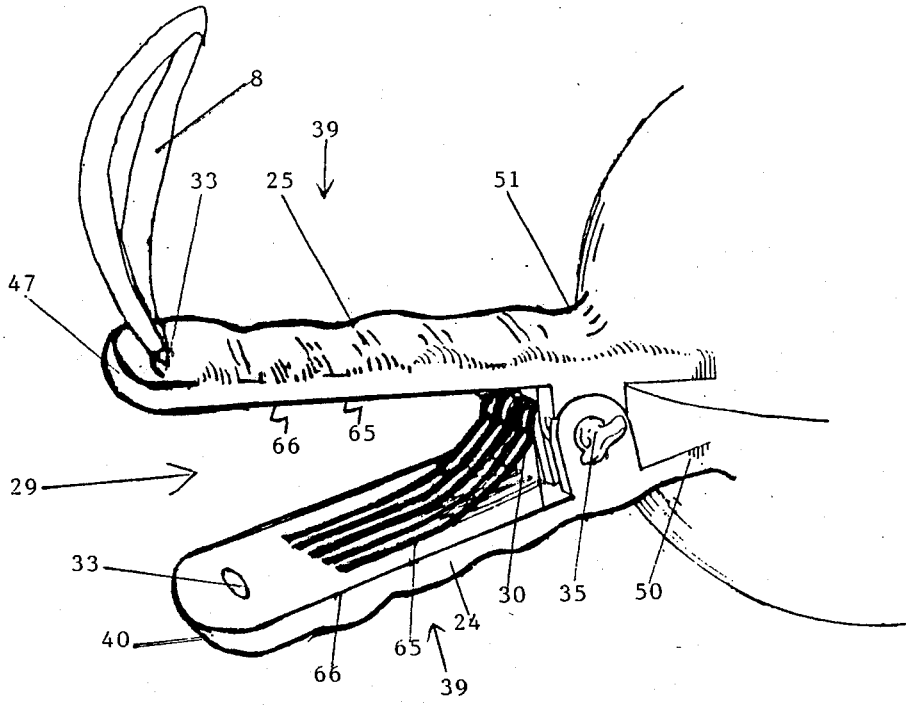
FIG. 2 is an enlarged view of the longitudinal arms with the engagement of five springs therein on a pivot rod which is secured on the extending end with a wing nut.
Figure 3:
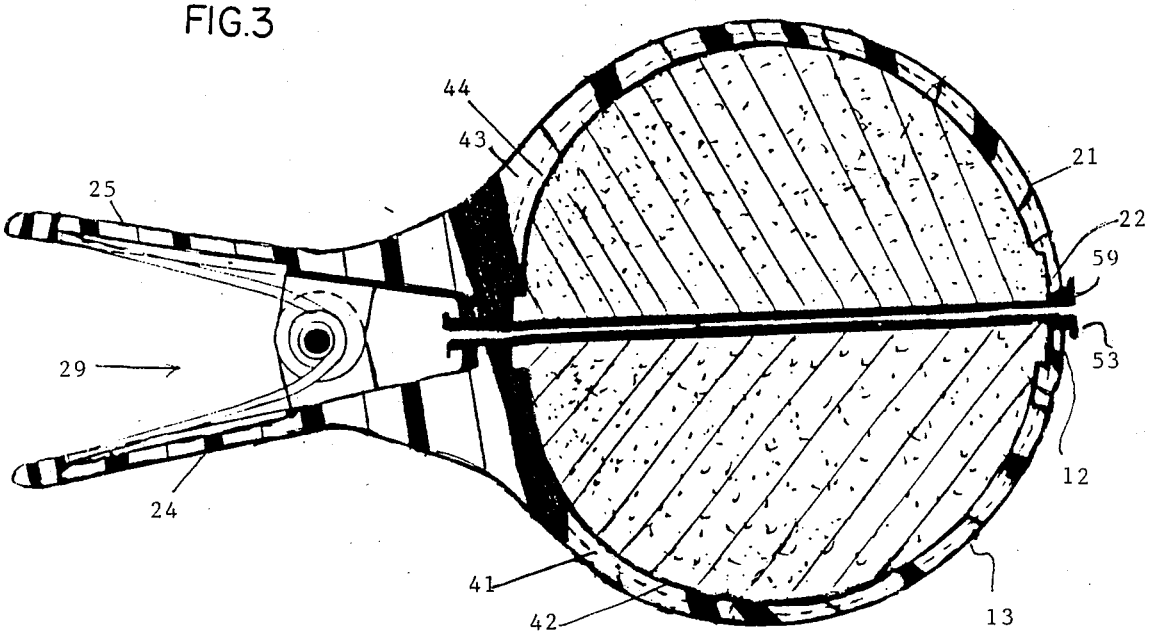
FIG. 3 is a longitudinal sectional view of the first and second chambers filled with sand and covered (sealed) with cover lids, in closed position.

The device includes a plurality of single-loop coil springs 65 (Fig.2, 65 represents each spring), having divergently extending ends. Each spring's ends are placed into a designated spring slot 66, one end into the first arm 24, and the second end 66 into the opposite (same marking) spring slot 66 of the second arm 25. Place additional springs 65 into different slots 66 to increase the tension. Preferrably, the second ends of each spring 65, may when fully compressed, (first end touching second end) exert 1 lb. of pressure, or 2 lbs. of pressure or more, individually. Therefore one spring with 1 lb. of pressure engaged into the unit will exert 1 lb. of pressure, and two springs will exert 2 lbs. of pressure, etc.

Figure 4:
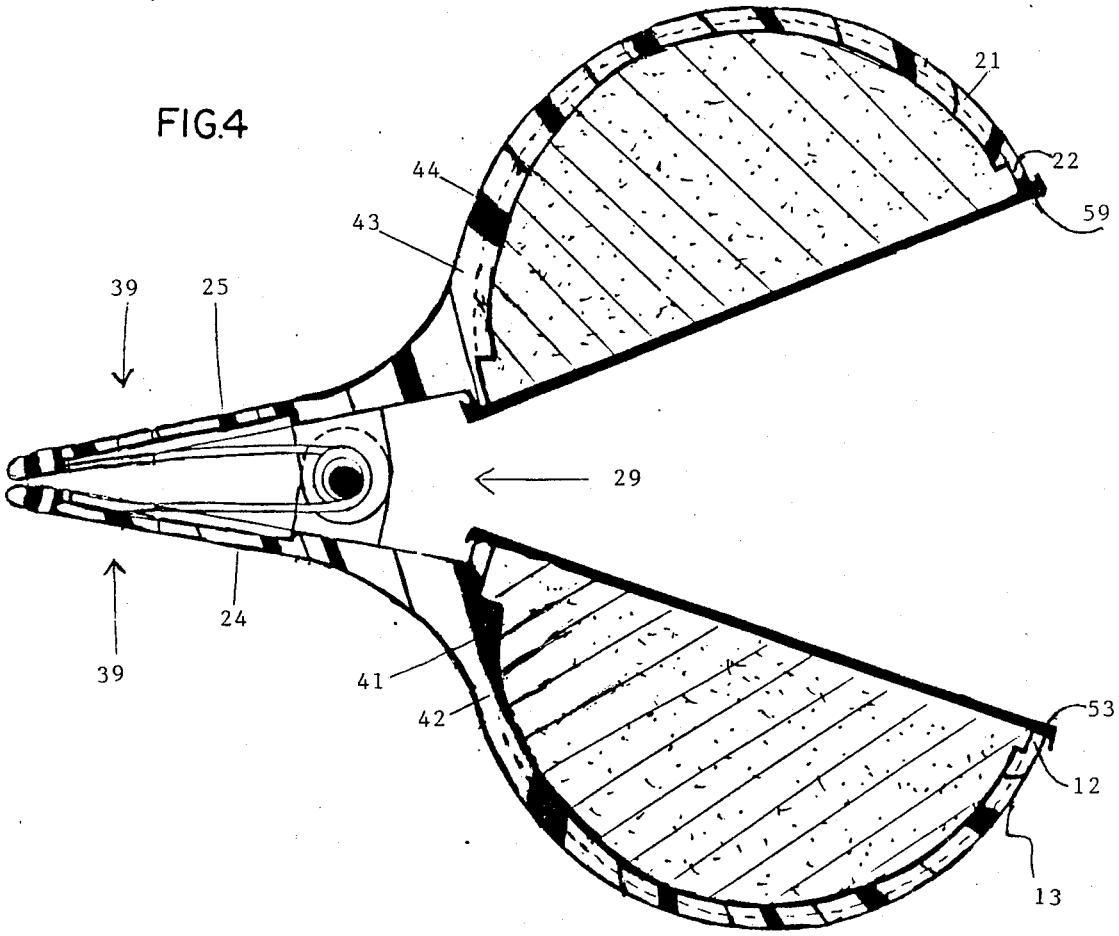
FIG. 4 is a longitudinal sectional view of FIG. 3 in open position.
Figure 7:
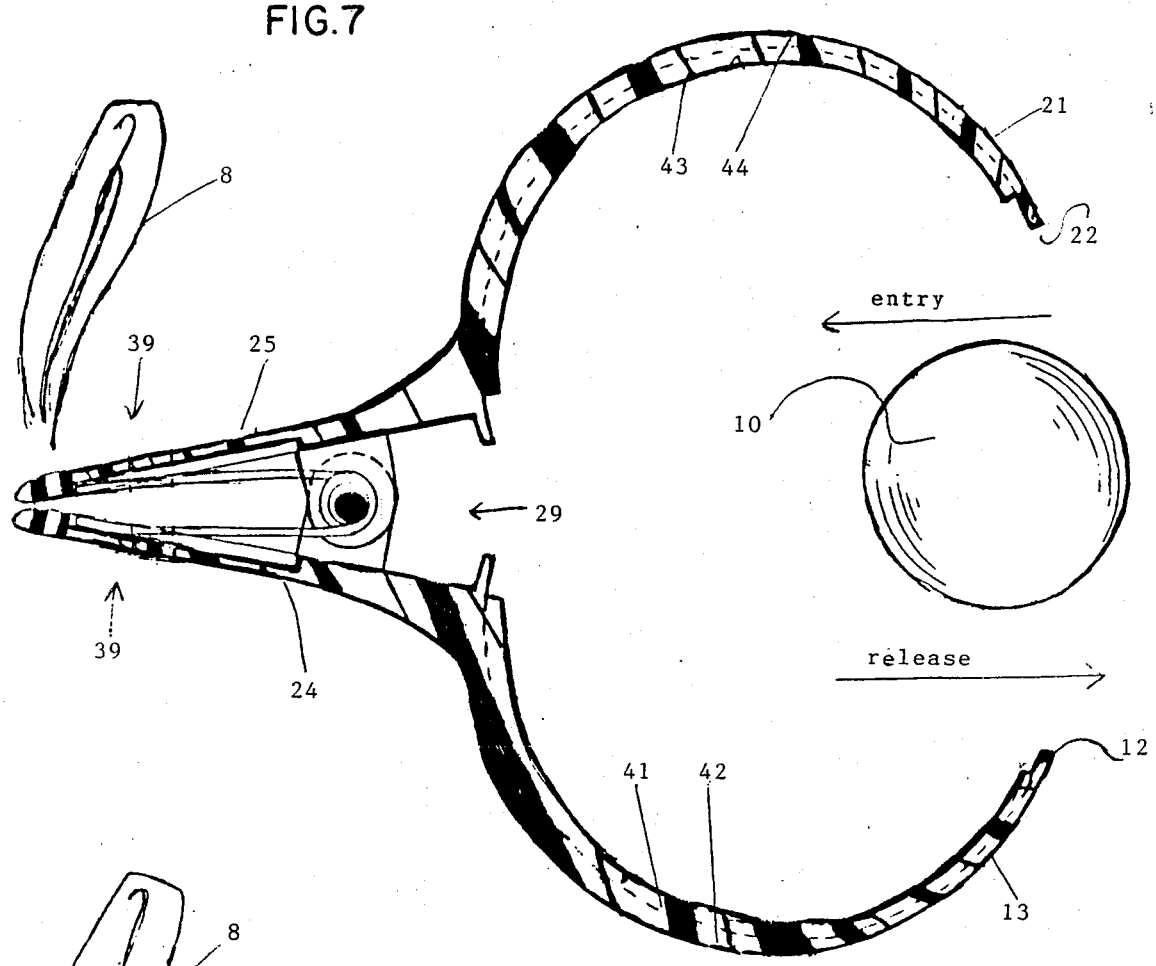
FIG. 7 is a longitudinal sectional view of the device showing an incoming ball.
Figure 8:
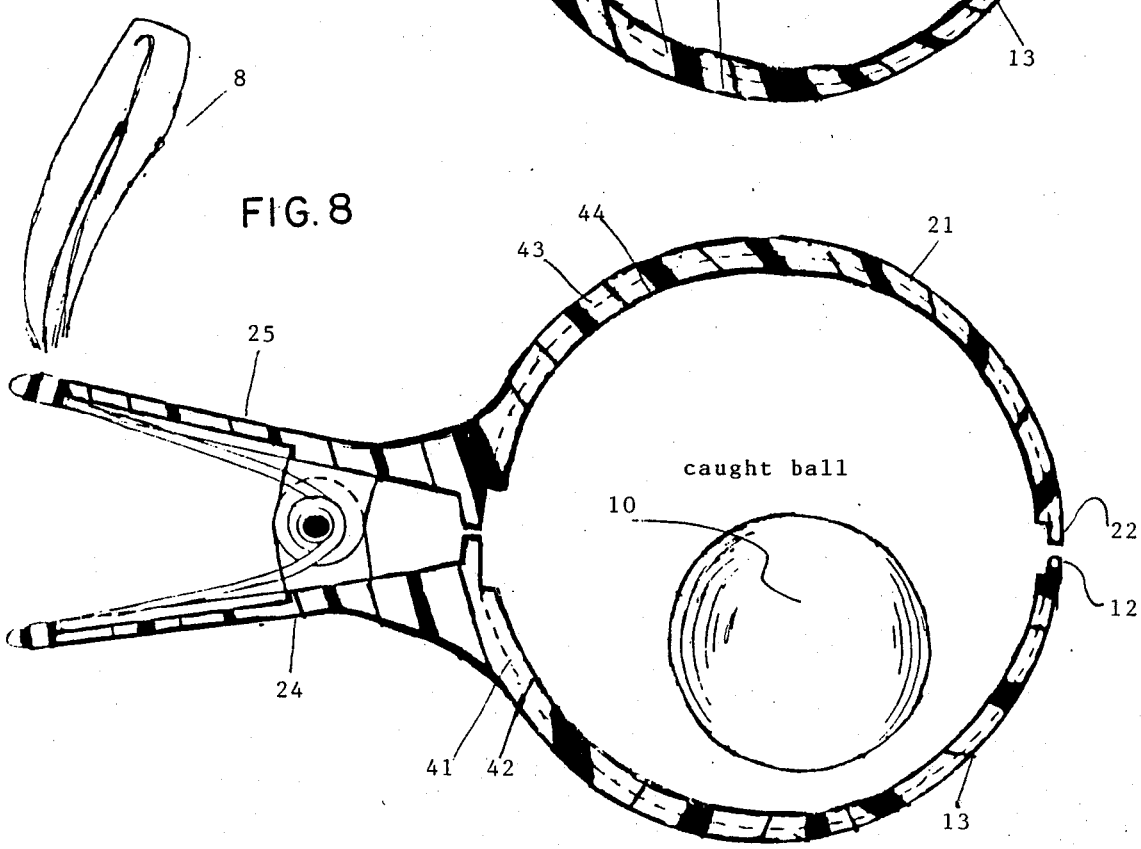
FIG. 8 is a longitudinal sectional view of the device showing a caught ball.

The device includes a removeable pivot rod 30(Fig.2) that may be inserted by the user through the first hinge 29 hole, and through the center coil of the spring 65, and on through the second hinge 29 hole, of which the extending end is bolted with a wing nut 35, or the like, holding the unit together. The pivot rod 30 aids in the pivoting action of the device, with the center coil of the spring floating around it while secured by its ends into the designated spring slots 66. The user will hold the unit's two arms 24,25 in the palm of his/her hand and squeeze (grip) them together, forcing the chambers 13,21, apart, and releasing the two arms to close the chambers (see, Figs.3 and 4, and FIGS. 7 and 8) The poundage of pressure comes from the push of the arms, with the spring intact. The actuator means 39 consists of the second end 40 of the first arm 24, and the second end 47, of the second arm 25. Now, the actuator is squeezed pivoting the device to throw and catch a ball from the chambers 13, 21, or to pivot the weight of the same chambers (see, FIGS. 3, 4 and Fig.7).

To place or add spring(s) into one unit, simply push the coiled end of the first spring into the joined inner arms, downward to the point of the hinge holes, and hold. Place the pivot rod through the first hinge hole through the center coil of the spring (add more springs, here) and on through the second hinge hole. Bolt a wing nut onto the extending end of the pivot rod, securely. Now, the user is ready to play ball with the unit, or use it (them) for general exercising.

The arm 24,25 (Fig.1) show injection molded molded finger-grips embedded therein. Let it be noted that rubber coatings, cushions, or the like may also be made thereon, in any manner. The moldings are to give the user a firmer hold to the device, making it safer to use. Let it also be noted that the cover lids 53,59 (FIG. 3 and 4) may also have rubber coatings, cushion pads, or the like affixed thereto the faces, in any manner, to soften the slapping impact of the chambers 13,21, when weighted (see FIGS. 3 and 4).

The device is to also include a ball, preferrably, two and one-fourth inches in dia. and of a med. texture, perhaps a "SUPERBALL" (high bounce or high speed ball), for fast play. A reg. tennis ball may also be used, or others of the like.

Figure 9:
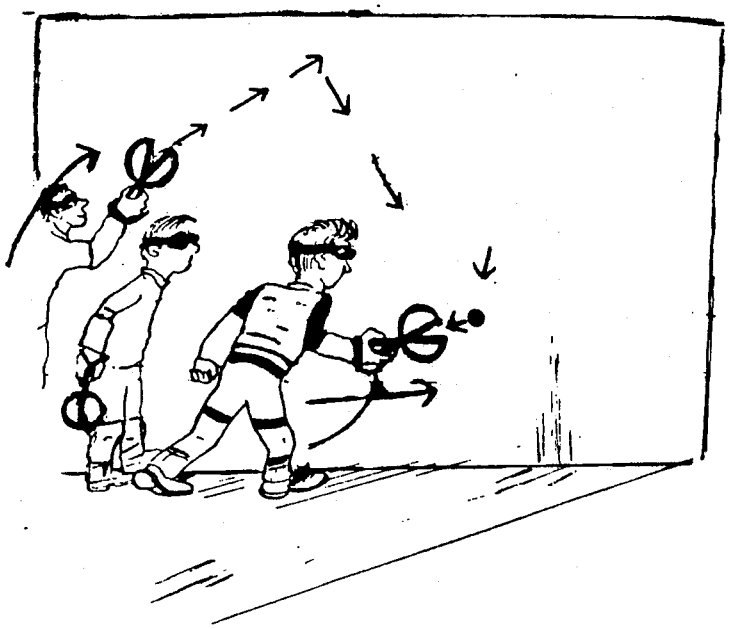
FIG. 9 is the ball shown played off a racket wall.

Preferrably, a racket wall, or any smooth surfaced wall may be used as a point of ball - return play (see FIG. 9). The user may serve the ball 10 (Fig.1) in like manner. Bounce the ball to the ground surface (pavement) about seventeen inches above their head, holding the unit by way of the handles (two arms), squeeze (opening hollow chambers apart), and catch the falling ball into the opening chambers, release the handles to catch (caught, see Fig.8) the incoming ball (see Figs.7 and 8 and Fig.9). Use the same procudure for catching an incoming ball, squeeze the handles open to catch the ball. To throw a ball, simply place the ball into the hollow chambers and close (release handles). Pull the unit with the ball intact, up over your shoulder and with a pitching motion, (ball will rotate inside chambers at this point, creating speed) simultaneously grip the arms together opening chambers to release the ball outward to the directed point of play (see FIG. 6 for guidelanes). Be sure the guidelanes are in an upward position from your hands (like Fig.6). Improper position of the guidelanes may cause failure to designate direction of the ball. Failure to cast the ball outwardly may be the lack of pivoting of the handles fully. That is how the said device can be used for ball game activity.

To use the device for simple hand,wrist and finger exercising, simply add springs as desired to tighten grip.

Hold the device by way of the two arms and grip and release, repetitiously. Now, the device is a simple hand-grip exerciser with advancing tension (by way of the springs).

For general grip, lift and pull exercise, add a rubber strap and add sand to the chambers for weighting, seal with cover lids, and plan your own exercise program. Now, the device is a pivotal dumbell.

Let it be noted to those skilled in the art that the arms 24,25 (Fig.1) and first ends 40,47 may be joined by any means, and by omitting the chambers 13,21, cover lids 53,59, straps 8 and 6, ball 10, and apertures 33 (both arms), said device may be used as a simple hand-grip exerciser with advancing tension, as described herein.

The present invention has been described and illustrated with a preferred embodiment(S) and certain uses, therefore, though it is not to be so limited since changed and modifications can be readily made therein which are within the intended spirit and scope of the present invention.

I claim:

1. A combination dumbell, hand-grip exerciser, and handgoal device comprising:

(a) a first and second chamber each having an open cavity for allowing any suitable substance entry into said cavities for weighting said device;

(b) a cover lid detachably attached to each of said chambers to close said cavities for retaining weighting material therein;

(c) a pair of projections extending from the interior surface of each said cavities to define guidelanes for directing a ball from said cavities when used as a handgoal;

(d) first and second longitudinal arms, each having first and second ends, the first end of the first arm being integral with the exterior surface of said first chamber, and the first end of the second arm being integral with the exterior surface of said second chamber;

(e) hinge means detachably attaching said arms together for relative pivoting;

(f) spring means selectively placeable on said hinge means for biasing said second ends of said arms apart and said chambers together.

2. The device of claim of 1 wherein said spring means comprises at least one coil spring with divergently extending ends; said hinge means further comprises a removeable pivotrod; and said arms further comprise longitudinally extending spring slots; whereby said at least one coil spring is selectively placeable between said arms and secureable therebetween with said pivot rod through the coil of said at least one coil spring, and said divergently extending ends stabilized within said spring slots.

3. The device of claim 1 futher comprising of a safety strap attached to the second end of one of said arms.

4. A combination dumbell, hand-grip exerciser, and handgoal device comprising in combination two of the devices set forth in claim 1, and futher including a resilient strap detachably attached therebetween.

* * * * *